US011473577B2

(12) United States Patent
Nakai et al.

(10) Patent No.: US 11,473,577 B2
(45) Date of Patent: Oct. 18, 2022

(54) COMPRESSOR HAVING INJECTION FUNCTION

(71) Applicant: Panasonic Intellectual Property Management Co., Ltd., Osaka (JP)

(72) Inventors: Hiroaki Nakai, Shiga (JP); Atsushi Sakuda, Shiga (JP); Takashi Morimoto, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 741 days.

(21) Appl. No.: 16/462,840

(22) PCT Filed: Oct. 12, 2017

(86) PCT No.: PCT/JP2017/036938
§ 371 (c)(1),
(2) Date: May 21, 2019

(87) PCT Pub. No.: WO2018/096825
PCT Pub. Date: May 31, 2018

(65) Prior Publication Data

US 2020/0063736 A1 Feb. 27, 2020

(30) Foreign Application Priority Data

Nov. 24, 2016 (JP) ..... JP2016-228338

(51) Int. Cl.
*F04C 18/02* (2006.01)
*F04C 23/00* (2006.01)
(Continued)

(52) U.S. Cl.
CPC ..... *F04C 18/0215* (2013.01); *F04C 23/008* (2013.01); *F04C 29/0007* (2013.01);
(Continued)

(58) Field of Classification Search
CPC .. F04C 18/0215; F04C 23/008; F04C 29/007; F04C 29/128; F04C 2210/261; F25B 1/04; F25B 2400/23
See application file for complete search history.

(56) References Cited

U.S. PATENT DOCUMENTS 5,722,257 A 3/1998 Ishii et al.
2013/0302198 A1* 11/2013 Ginies ..... F04C 29/128 418/55.1

(Continued)

FOREIGN PATENT DOCUMENTS

JP 57-076286 5/1982
JP 2002-013491 1/2002

(Continued)

OTHER PUBLICATIONS

Translation JP-2009180176-A.*

*Primary Examiner* — Elizabeth J Martin
(74) *Attorney, Agent, or Firm* — Hamre, Schumann, Mueller & Larson, P.C.

(57) ABSTRACT

A compression chamber includes the compression chamber partitioning member, an intermediate pressure chamber guides an intermediate pressure working fluid before injection to the compression chamber, and the intermediate pressure chamber and the compression chamber face each other with a compression chamber partitioning member interposed between the intermediate pressure chamber and the compression chamber. Further, the intermediate pressure chamber includes an intermediate pressure chamber inlet through which an intermediate pressure working fluid flows, an injection port inlet of an injection port through which the intermediate pressure working fluid is injected into the compression chamber, and a liquid reservoir formed at a position below the intermediate pressure chamber inlet, and
(Continued)

the liquid reservoir is formed by the compression chamber partitioning member.

9 Claims, 7 Drawing Sheets

(51) Int. Cl.
*F04C 29/00* (2006.01)
*F04C 29/12* (2006.01)
*F25B 1/04* (2006.01)

(52) U.S. Cl.
CPC ..... *F04C 29/128* (2013.01); *F04C 2210/261* (2013.01); *F25B 1/04* (2013.01); *F25B 2400/23* (2013.01)

(56) References Cited

U.S. PATENT DOCUMENTS

| | | | | |
|---|---|---|---|---|
| 2015/0192127 | A1 | 7/2015 | Nagano et al. | |
| 2017/0241417 | A1* | 8/2017 | Jin | F04C 29/126 |
| 2018/0066873 | A1* | 3/2018 | Maeyama | F25B 1/04 |
| 2018/0128270 | A1* | 5/2018 | Koyama | F04C 18/0215 |

FOREIGN PATENT DOCUMENTS

| | | | |
|---|---|---|---|
| JP | 3745801 | | 2/2006 |
| JP | 2009-180176 | | 8/2009 |
| JP | 2009180176 | A * | 8/2009 |
| JP | 2015-129477 | | 7/2015 |

* cited by examiner

COMPRESSOR HAVING INJECTION FUNCTION

This application is a U.S. national stage application of the PCT International Application No. PCT/JP2017/036938 filed on Oct. 12, 2017, which claims the benefit of foreign priority of Japanese patent application No. 2016-228338 filed on Nov. 24, 2016, the contents all of which are incorporated herein by reference.

TECHNICAL FIELD

The present invention relates to a compressor having an injection function, which is particularly used for a refrigeration machine such as an air conditioner, a water heater, and a refrigerator.

BACKGROUND ART

In a refrigeration apparatus and an air conditioner, a compressor is used which sucks a gas refrigerant evaporated by an evaporator, compresses the gas refrigerant to a pressure required for condensation by a condenser, and sends high-temperature high-pressure gas refrigerant to a refrigerant circuit. Thus, a compressor having an injection function is provided with two expansion valves between the condenser and the evaporator and injects an intermediate-pressure refrigerant flowing between the two expansion valves to a compression chamber during a compression process, thereby aiming to reduce power consumption and improve capacity of a refrigeration cycle.

That is, the refrigerant circulating in the condenser is increased by the amount of the injected refrigerant. In the air conditioner, heating capacitor is improved. Further, since the injected refrigerant is in an intermediate pressure state, and power required for compression ranges from the intermediate pressure to the high pressure, a coefficient of performance (COP) can be improved and power consumption can be reduced, as compared to a case where the same function is provided without injection.

The amount of the refrigerant flowing in the condenser is equal to a sum of the amount of the refrigerant flowing in the evaporator and the amount of the injected refrigerant, and a ratio of the amount of the injected refrigerant to the amount of the refrigerant flowing in the condenser is an injection rate.

To increase an effect of injection, the injection rate may increase. Thus, the refrigerant is injected due to a pressure difference between the pressure of the injected refrigerant and the internal pressure of a compression chamber. To increase the injection rate, it is necessary to increase the pressure of the injected refrigerant.

However, when the pressure of the injected refrigerant increases, a liquid refrigerant is injected to the compression chamber, which causes a decrease in heating capacity and a decrease in reliability of the compressor.

By the way, in the scroll compressor according to the related art, an intermediate pressure chamber for suppressing pressure pulsation of the refrigerant injected into the compression chamber is disclosed (for example, see PTL 1). Since a ratio (hereinafter, referred to as an injection rate) of the amount of the refrigerant injected into the compression chamber to the amount of the refrigerant flowing in the condenser is reduced due to occurrence of the pressure pulsation, in the scroll compressor disclosed in PTL 1, the pressure pulsation is suppressed, and thus the injection rate increases.

CITATION LIST

Patent Literature

PTL 1: Japanese Patent No. 3745801

SUMMARY OF THE INVENTION

In a refrigerant injected into a compression chamber, a method of controlling two expansion valves exists as one of methods of controlling a generation ratio of a gas refrigerant and a liquid refrigerant. However, there is little difference between a state in which the gas refrigerant is injected without excessiveness and shortage and a state in which a part of a liquid refrigerant is mixed in an injection pipe. In order to ensure reliability of the compressor, a design is not limited to either gas injection or liquid injection. It is assumed that in a state in which the gas refrigerant and the liquid refrigerant are mixed with each other, the mixed refrigerant is introduced from the injection pipe to the compression chamber.

In the refrigerant introduced into the compression chamber from an injection pipe, the gas refrigerant is preferentially extracted from a gas-liquid separator and is fed. However, when balance of intermediate pressure control is broken or when a transient condition is changed, in a state in which the liquid refrigerant is mixed with the gas refrigerant, the mixture is introduced from the injection pipe to the compression chamber. In the compression chamber having many sliding parts, in order to keep a sliding state good, an appropriate amount of oil is fed and is compressed together with the refrigerant. However, when the liquid refrigerant is mixed, the oil in the compression chamber is washed by the liquid refrigerant. Thus, the sliding state deteriorates, components are worn or burned. Thus, it is important that the liquid refrigerant introduced from the injection pipe is not fed to the compression chamber as far as possible and only the gas refrigerant is guided to an injection port.

PTL 1 is a configuration in which the gas injection or the liquid injection is selected. In a state in which the gas refrigerant and the liquid refrigerant are mixed with each other, it is not assumed that the refrigerant flows from the injection pipe, and there is no comment of the solution.

According to the present invention, there is provided a compressor having an injection function, in which even if a liquid-phase working fluid is mixed with a gas-phase working fluid which is gas-injected, flow of the liquid-phase working fluid into the compression chamber is suppressed by the intermediate pressure chamber. As the liquid refrigerant is evaporated in the intermediate pressure chamber, high reliability can be realized while operation is performed at an optimum intermediate pressure at high efficiency.

The compressor having an injection function according to the present invention is a compressor having an injection function, which suctions a low-pressure working fluid, injects the intermediate pressure working fluid into the compression chamber in a process of compressing the low-pressure working fluid, and discharges a high-pressure working fluid. Thus, the compression chamber includes, for example, a compression chamber partitioning member configured with the fixed scroll, and the intermediate pressure chamber guiding the intermediate-pressure working fluid before the injection to the compression chamber. Further, the intermediate pressure chamber and the compression chamber face each other with the compression chamber partitioning member interposed between the intermediate pressure chamber and the compression chamber, the intermediate pressure chamber includes an intermediate pressure chamber inlet through which an intermediate pressure working fluid flows in, an injection port inlet of an injection port through which the intermediate pressure working fluid is injected into the compression chamber, and a liquid reservoir formed at a position below the intermediate pressure chamber inlet. Further, the liquid reservoir includes the compression chamber partitioning member.

With this configuration, even when a liquid-phase working fluid exists in a part of the intermediate pressure working fluid, the liquid-phase working fluid is evaporated by the liquid reservoir to be converted into the gas-phase working fluid. Thus, operation can be performed at an optimum intermediate pressure at high efficiency without injecting the liquid-phase working fluid into the compression chamber, and lubricity of sliding portions does not deteriorate due to the liquid refrigerant. Thus, a stable compressor can be provided.

DESCRIPTION OF EMBODIMENTS

First Embodiment

Hereinafter, a compressor having an injection function according to a first embodiment of the present invention will be described. The present invention is not limited to the following embodiments.

Figure 1:
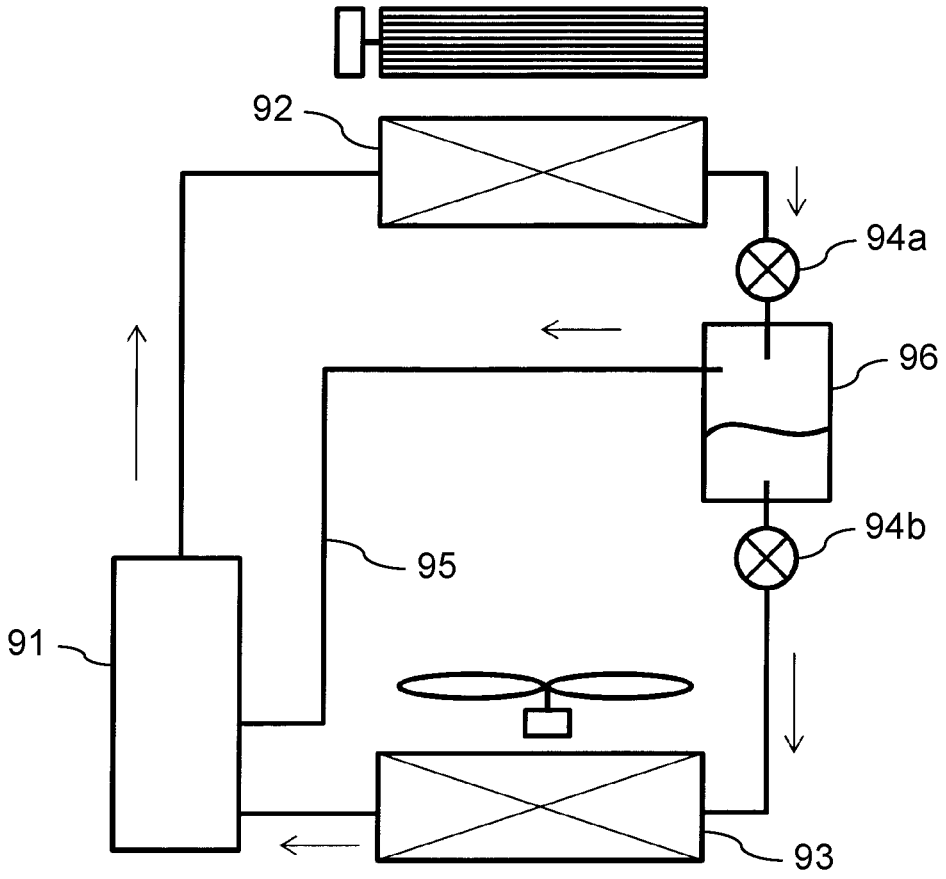
FIG. 1 is a diagram showing a refrigeration cycle including a compressor having an injection function according to a first embodiment of the present invention.

FIG. 1 is a diagram showing a refrigeration cycle including the compressor having an injection function according to the first embodiment.

As illustrated in FIG. 1, a refrigeration cycle device according to the present embodiment includes compressor 91, condenser 92, evaporator 93, expansion valves 94*a* and 94*b*, injection pipe 95, and gas-liquid separator 96.

A refrigerant, which is a working fluid condensed by condenser 92, is depressurized to an intermediate pressure by expansion valve 94*a* on an upstream side, and gas-liquid separator 96 separates the refrigerant at the intermediate pressure into a gas-phase component (a gas refrigerant) and a liquid-phase component (a liquid refrigerant). The liquid refrigerant depressurized to the intermediate pressure further passes through expansion valve 94*b* on the downstream side, becomes a low-pressure refrigerant, and is guided to evaporator 93.

The liquid refrigerant sent to evaporator 93 is evaporated by heat exchange and is discharged as the gas refrigerant or the gas refrigerant partially mixed with the liquid refrigerant. The refrigerant discharged from evaporator 93 is incorporated in the compression chamber of compressor 91.

Meanwhile, the gas refrigerant separated by gas-liquid separator 96 and being at an intermediate pressure passes through injection pipe 95 and is guided to the compression chamber in compressor 91. A closure valve or a pressure reducer is provided in injection pipe 95 and is suitable for a configuration that adjusts and stops the injection pressure.

Compressor 91 compresses a low-pressure refrigerant flowing from evaporator 93, injects the refrigerant in gas-liquid separator 96 at an intermediate pressure to the compression chamber in a compression process to compress the refrigerant, and sends the high-temperature high-pressure refrigerant from a discharge pipe to condenser 92.

In a ratio of the liquid-phase component to the gas-phase component of the refrigerant separated by gas-liquid separator 96, as a pressure difference between an inlet-side pressure and an outlet-side pressure of expansion valve 94*a* provided on the upstream side increases, the amount of the gas-phase component increases. Further, as a supercooling degree of the refrigerant at an outlet of condenser 92 decreases or a depletion degree thereof increases, the amount of the gas-phase component increases.

Meanwhile, the amount of the refrigerant sucked through injection pipe 95 by compressor 91 increases as the intermediate pressure increases. Thus, when the refrigerant of which the ratio of the gas-phase component is more than the ratio of the gas-phase component of the refrigerant separated by gas-liquid separator 96 is sucked from injection pipe 95, the gas refrigerant in gas-liquid separator 96 is depleted, and the liquid refrigerant flows to injection pipe 95. It is preferable that in order to maximize capacity of compressor 91, the gas refrigerant separated by gas-liquid separator 96 is sucked from injection pipe 95 to compressor 91. However, when the refrigerant escapes from this balanced state, the liquid refrigerant flows from injection pipe 95 to compressor 91. Thus, even in this case, it is necessary that compressor 91 is configured to maintain high reliability.

The intermediate pressure is controlled by adjusting opening degrees of expansion valves 94*a* and 94*b* respectively provided on an upstream side and a downstream side of gas-liquid separator 96. The injected refrigerant is sent to the compression chamber by a pressure difference between the internal pressure and the intermediate pressure of the compression chamber in compressor 91 to which injection pipe 95 is finally connected. Therefore, when the intermediate pressure is adjusted high, the injection rate increases. Meanwhile, since a gas-phase component ratio of the refrigerant flowing from condenser 92 through expansion valve 94*a* on the upstream side into gas-liquid separator 96 decreases as the intermediate pressure increases, when the intermediate pressure excessively increases, the amount of the liquid refrigerant in gas-liquid separator 96 increases, and the liquid refrigerant flows into injection pipe 95, which affects a reduction in heating capacity and reliability of compressor 91. Thus, a configuration that receives the large amount of the injected refrigerant due to an intermediate pressure as low as possible is suitable as compressor 91, and a scroll type method in which a compression rate is slow is suitable as a compression method.

Figure 2:
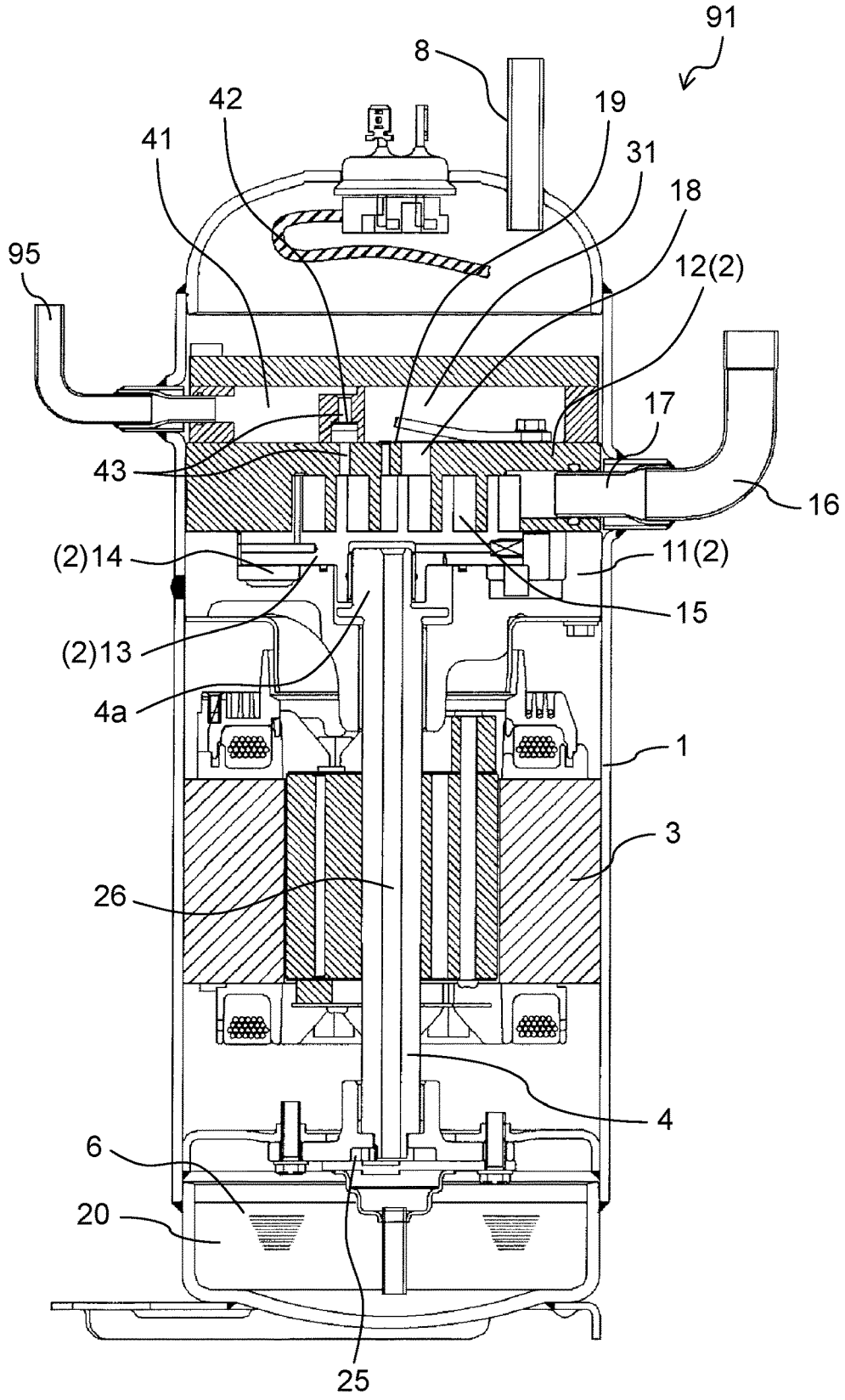
FIG. 2 is a longitudinal sectional view showing the compressor having an injection function according to the first embodiment of the present invention.
Figure 3:
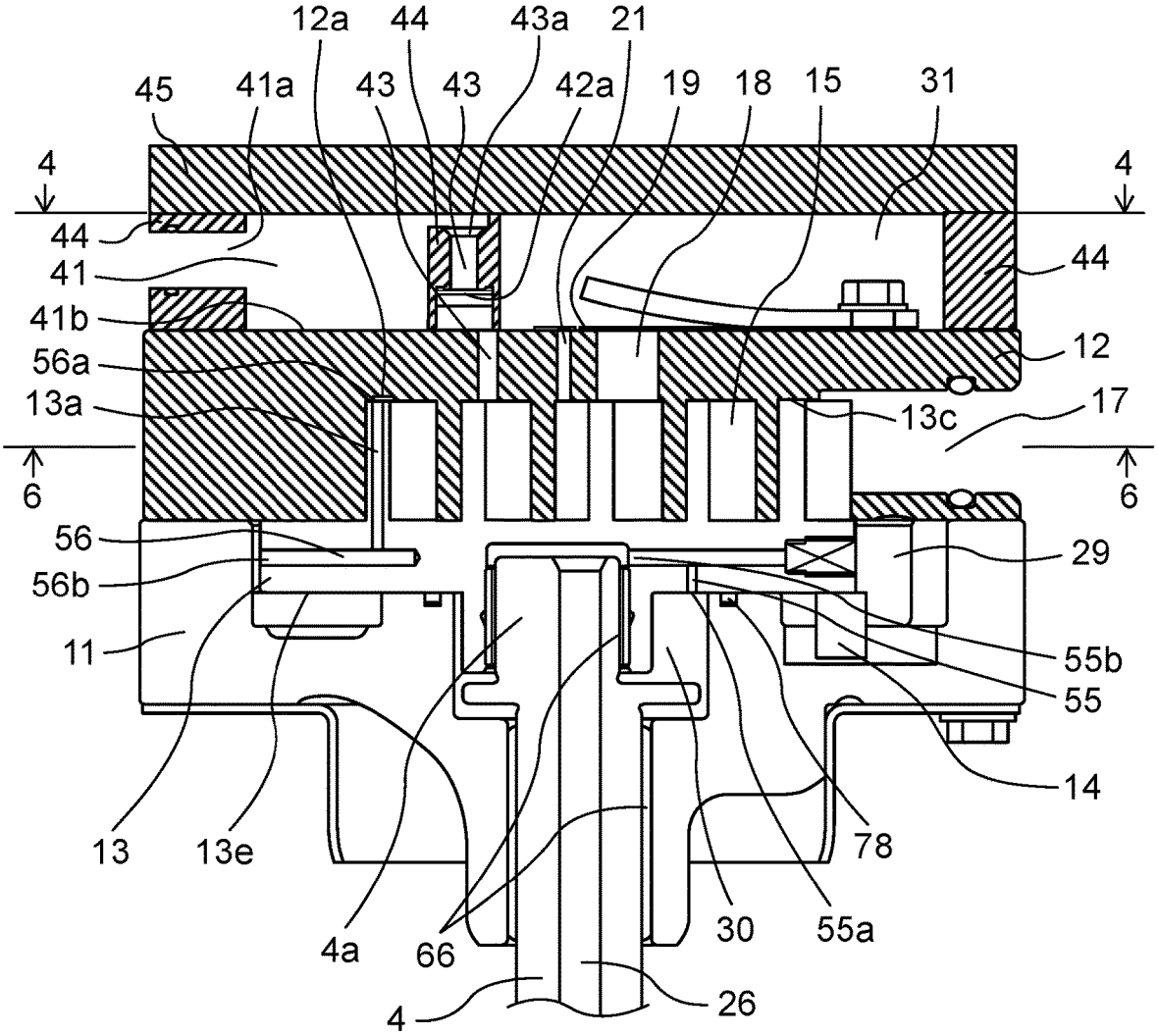
FIG. 3 is an enlarged view showing a main part of FIG. 2.
Figure 4:
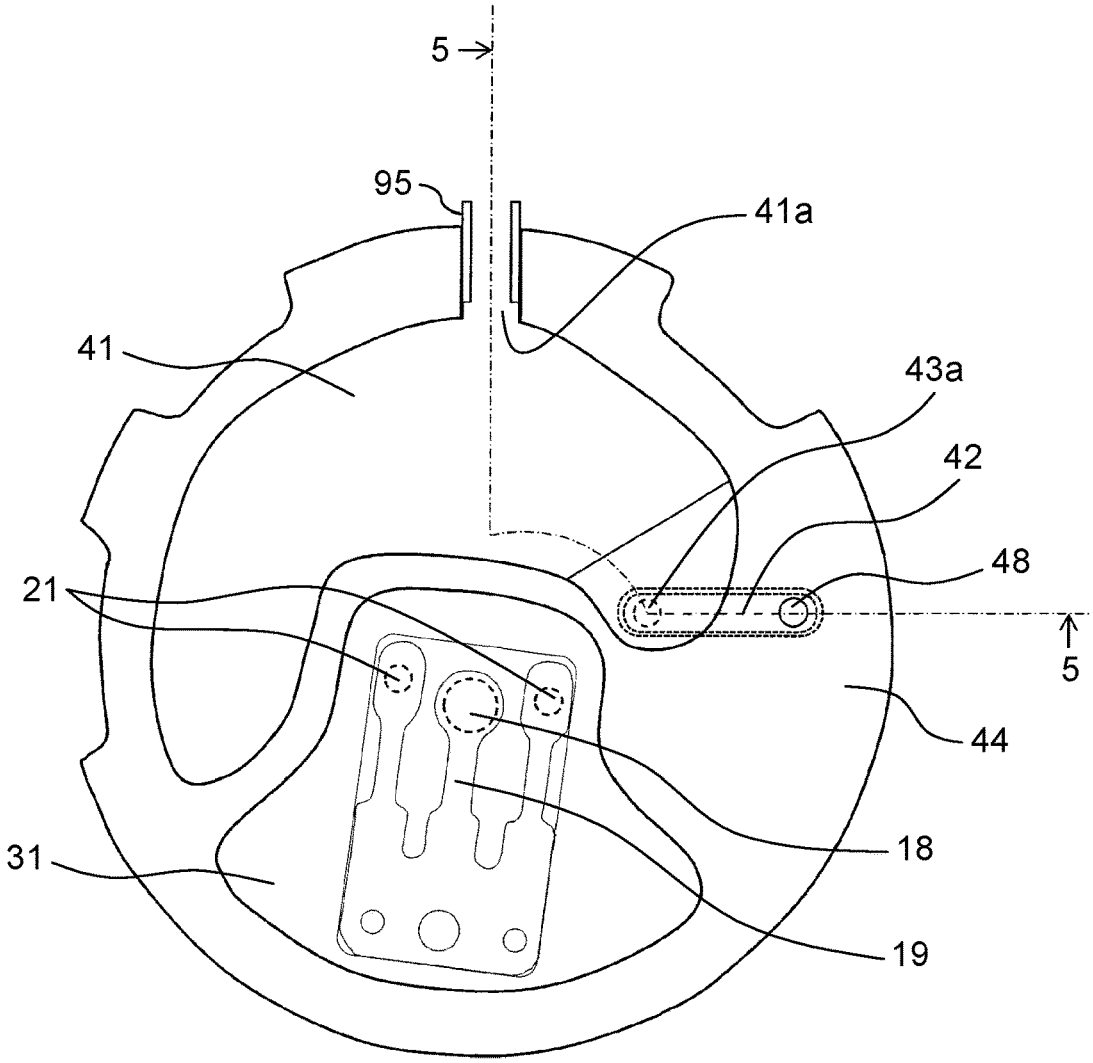
FIG. 4 is a view taken along line 4-4 of FIG. 3.
Figure 5:
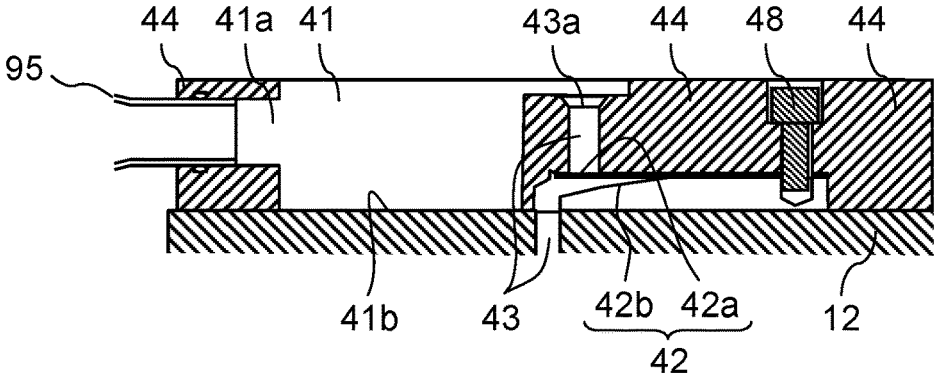
FIG. 5 is a view taken along line 5-5 of FIG. 4.

FIG. 2 is a longitudinal sectional view showing the compressor having an injection function according to the present embodiment. FIG. 3 is an enlarged view showing a main part of FIG. 2. FIG. 4 is a view taken along line 4-4 of FIG. 3. FIG. 5 is a view taken along line 5-5 of FIG. 4. Compressor 91 having an injection function according to the present embodiment is a scroll compressor.

As illustrated in FIG. 2, compressor 91 includes compression mechanism 2, motor unit 3, and oil reservoir 20 inside sealed container 1.

Compression mechanism 2 includes main bearing member 11 fixed to sealed container 1 through welding or shrink fitting, fixed scroll 12 which is fixed to main bearing member 11 through a bolt and is a compression chamber partitioning member, and orbiting scroll 13 engaged with fixed scroll 12. Shaft 4 is pivotally supported by main bearing member 11.

Further, compression mechanism 2 is provided with rotation restraining mechanism 14 such as an Oldham ring that guides orbiting scroll 13 such that the Oldham ring prevents rotation of orbiting scroll 13 and orbiting scroll 13 orbits circularly. In the present embodiment, the Oldham ring which is rotation restraining mechanism 14 is disposed between orbiting scroll 13 and main bearing member 11.

Orbiting scroll 13 is fitted in and eccentrically driven by eccentric shaft portion 4*a* at an upper end of shaft 4 and circularly orbits by rotation restraining mechanism 14.

Compression chamber 15 is formed between fixed scroll 12 and orbiting scroll 13.

Suction pipe 16 penetrates sealed container 1 to the outside, and suction port 17 is provided at an outer circumferential portion of fixed scroll 12. The working fluid (the refrigerant) sucked from suction pipe 16 is guided from suction port 17 to compression chamber 15. Compression chamber 15 moves while the volume from the outer peripheral side toward the central portion is reduced, to increase the pressure of the sucked working fluid. The working fluid that reaches a predetermined pressure in compression chamber 15 is discharged from discharge port 18 provided at a central portion of fixed scroll 12 to discharge chamber 31. Discharge reed valve 19 is provided in discharge port 18. The working fluid that reaches the predetermined pressure in compression chamber 15 pushes and opens discharge reed valve 19 to be discharged to discharge chamber 31. The working fluid discharged to discharge chamber 31 flows to an upper end of sealed container 1 through a not-shown passage, and is discharged to the outside of sealed container 1 through discharge pipe 8.

Meanwhile, the working fluid at the intermediate pressure, guided from injection pipe 95, flows to intermediate pressure chamber 41, opens check valve 42 provided in injection port 43, is injected into compression chamber 15 after the working fluid is enclosed, and is discharged from discharge port 18 into discharge chamber 31 in sealed container 1 together with the working fluid sucked from suction port 17.

Pump 25 is provided at a lower end of shaft 4. Pump 25 is disposed such that a suction port thereof exists in oil reservoir 20. Pump 25 is driven by shaft 4 and can certainly pump up oil 6 in oil reservoir 20 provided at a bottom portion of sealed container 1 regardless of a pressure condition and an operation speed. Thus, a concern about shortage of oil 6 in compression mechanism 2 or the like is alleviated. Oil 6 pumped up by pump 25 is supplied to compression mechanism 2 through oil supplying hole 26 formed in shaft 4. Before and after oil 6 is pumped up by pump 25, when foreign substances are removed from oil 6 by an oil filter or the like, the foreign substances can be prevented from being introduced into compression mechanism 2, and reliability can be further improved.

The pressure of oil 6 guided to compression mechanism 2 is substantially the same as a discharge pressure of the scroll compressor and serves as a back pressure source for orbiting scroll 13. Accordingly, orbiting scroll 13 stably exhibits a predetermined compression function without being separated from or colliding with fixed scroll 12.

As illustrated in FIG. 3, ring-shaped sealing member 78 is disposed on rear surface 13*e* of an end plate of orbiting scroll 13.

High-pressure area 30 is formed inside sealing member 78, and back-pressure chamber 29 is formed outside sealing member 78. Back-pressure chamber 29 is set to a pressure between a high pressure and a low pressure. Since high-pressure area 30 and back-pressure chamber 29 can be separated from each other using sealing member 78, application of the pressure from rear surface 13*e* of orbiting scroll 13 can be stably controlled.

Figure 6:
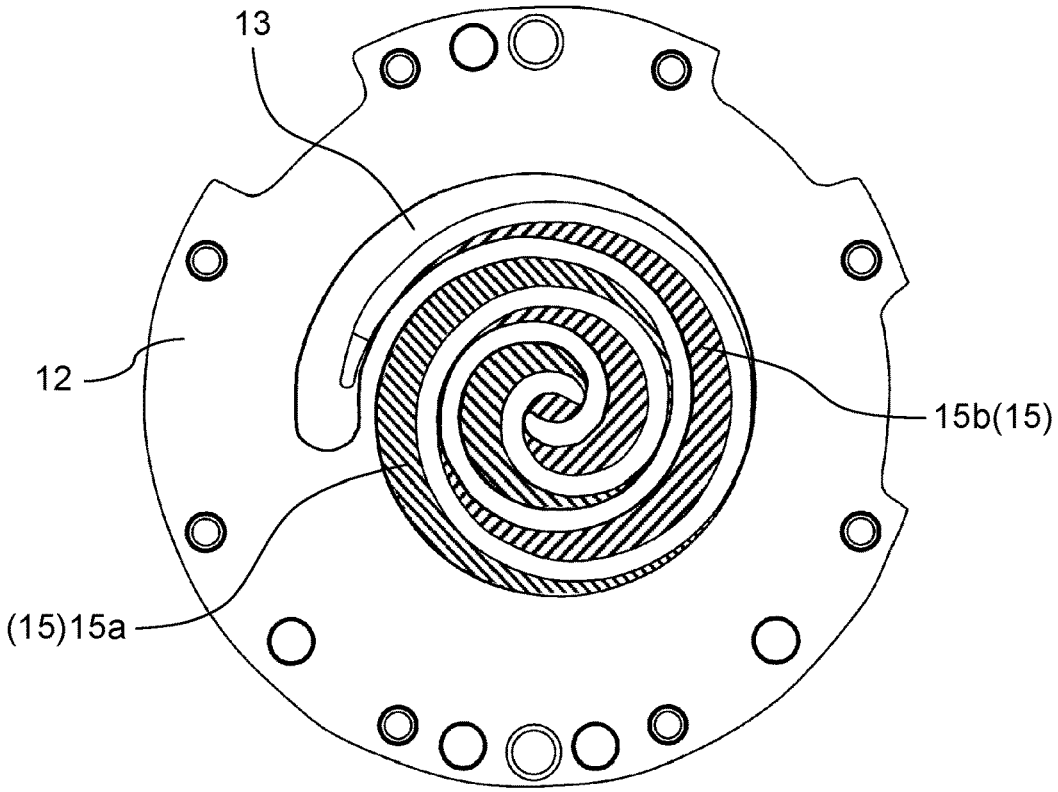
FIG. 6 is a view taken along line 6-6 of FIG. 3.

As illustrated in FIG. 6 that is a view taken along line 6-6 of FIG. 3, compression chamber 15 formed with fixed scroll 12 and orbiting scroll 13 includes first compression chamber 15*a* formed on an outer wrap wall side of orbiting scroll 13 and second compression chamber 15*b* formed on an inner wrap wall side.

Connection passage 55 from high-pressure area 30 to back-pressure chamber 29 and supply passage 56 from back-pressure chamber 29 to second compression chamber 15*b* are provided as an oil supplying passage from oil reservoir 20. As connection passage 55 from high-pressure area 30 to back-pressure chamber 29 is provided, oil 6 can be supplied to a sliding portion of rotation restraining mechanism 14 and a thrust sliding portion of fixed scroll 12 and orbiting scroll 13.

First opening end 55*a* of connection passage 55 is formed on rear surface 13*e* of orbiting scroll 13 and travels sealing member 78, and second opening end 55*b* is always open to high-pressure area 30. Accordingly, intermittent oil supplying can be realized.

A part of oil 6 enters a fitting portion between eccentric shaft portion 4*a* and orbiting scroll 13 and bearing portion 66 between shaft 4 and main bearing member 11 so as to obtain an escape area by supply pressure or self weight, falls after lubricating each component, and returns to oil reservoir 20.

In the scroll compressor according to the present embodiment, the oil supplying passage to compression chamber 15 is configured with passage 13*a* formed inside orbiting scroll 13 and recess 12*a* formed in a wrap side end plate of fixed scroll 12. Third opening end 56*a* of passage 13*a* is formed at wrap tip end 13*c* and is periodically opened to recess 12*a* according to the orbiting movement. Further, fourth opening end 56*b* of passage 13*a* is always open to back-pressure chamber 29. Accordingly, back-pressure chamber 29 and second compression chamber 15*b* can intermittently communicate with each other (see FIGS. 6 and 9).

Injection port 43 for injecting the refrigerant at the intermediate pressure is provided to penetrate the end plate of fixed scroll 12. Injection port 43 is sequentially open to first compression chamber 15*a* and second compression chamber 15*b*. Injection port 43 is provided at a position where injection port 43 is open during a compression process after the refrigerant is introduced into and closed in first compression chamber 15*a* and second compression chamber 15*b*.

Discharge bypass port 21 through which the refrigerant compressed in compression chamber 15 is discharged before discharge bypass port 21 communicates with discharge port 18 is provided in the end plate of fixed scroll 12.

As illustrated in FIGS. 3 and 4, compressor 91 according to the present embodiment is provided with intermediate pressure chamber 41 that guides an intermediate pressure working fluid fed from injection pipe 95 and before being injected into the compression chamber 15.

Intermediate pressure chamber 41 includes fixed scroll 12 that is a compression chamber partitioning member, intermediate pressure plate 44 and intermediate pressure cover 45 constituting the intermediate pressure chamber partitioning member. Intermediate pressure chamber 41 and compression chamber 15 face each other with fixed scroll 12 interposed between intermediate pressure chamber 41 and compression chamber 15. Intermediate pressure chamber 41 includes intermediate pressure chamber inlet 41*a* through which the intermediate pressure working fluid flows in and liquid reservoir 41*b* formed at a position lower than intermediate pressure chamber inlet 41*a* and injection port inlet 43*a* of injection port 43 through which the intermediate pressure working fluid is injected into compression chamber 15.

Liquid reservoir 41*b* is formed on an upper surface of the end plate of fixed scroll 12.

Intermediate pressure plate 44 is provided with check valve 42 that prevents backflow of the refrigerant from compression chamber 15 to intermediate pressure chamber 41. In a section in which injection port 43 is open to compression chamber 15, when the internal pressure of compression chamber 15 is higher than the intermediate pressure of injection port 43, the refrigerant flows backward from compression chamber 15 to intermediate pressure chamber 41. Thus, check valve 42 is provided to prevent the backflow of the refrigerant.

In compressor 91 according to the present embodiment, check valve 42 is configured with reed valve 42*a* lifted to compression chamber 15 side and causing compression chamber 15 and intermediate pressure chamber 41 to communicate with each other. Check valve 42 causes compression chamber 15 and intermediate pressure chamber 41 to communicate with each other only when the internal pressure of compression chamber 15 is lower than the pressure of intermediate pressure chamber 41. By using reed valve 42*a*, the number of sliding portions in a movable portion is small, sealing performance can be maintained for a long time, and a flow passage area can be easily enlarged as needed. When check valve 42 is not provided or check valve 42 is provided in injection pipe 95, the refrigerant in compression chamber 15 flows backward to injection pipe 95, and unnecessary compression power is consumed. Check valve 42 according to the present embodiment is provided in intermediate pressure plate 44 close to compression chamber 15 to suppress the backflow from compression chamber 15.

The upper surface of the end plate of fixed scroll 12 is located below intermediate pressure chamber inlet 41*a*, and the upper surface of the end plate of fixed scroll 12 is provided with liquid reservoir 41*b* in which the working fluid in a liquid-phase component is collected. Further, injection port inlet 43*a* is provided at a position higher than the height of intermediate pressure chamber inlet 41*a*. Thus, among the intermediate pressure working fluid, the working fluid in a gas-phase component is guided to injection port 43. Since the working fluid in the liquid-phase component collected in liquid reservoir 41*b* is evaporated in the surface of fixed scroll 12 in a high-temperature state, it is difficult for the working fluid in the liquid-phase component to flow into compression chamber 15.

Further, intermediate pressure chamber 41 and discharge chamber 31 are provided adjacent to each other through intermediate pressure plate 44. It is possible to suppress an increase in the temperature of the high-pressure refrigerant of discharge chamber 31 while evaporation when the working fluid in the liquid-phase component flows into intermediate pressure chamber 41 is promoted. Thus, operation can be performed even in a high discharge pressure condition by that degree.

The intermediate pressure working fluid guided to injection port 43 pushes and opens reed valve 42*a* by a pressure difference between injection port 43 and compression chamber 15 and is joined to a low-pressure working fluid sucked by suction port 17 in compression chamber 15. However, the intermediate pressure working fluid remaining in injection port 43 between check valve 42 and compression chamber 15 is repeatedly expanded and compressed again, which causes a decrease in efficiency of compressor 91. Thus, the thickness of valve stop 42*b* (see FIG. 5) for regulating a maximum displacement of reed valve 42*a* is changed according to the lift regulation point of reed valve 42*a*, and the volume of injection port 43 downstream of reed valve 42*a* is configured to be small.

Further, reed valve 42*a* and valve stop 42*b* are fixed to intermediate pressure plate 44 through bolt 48 that is a fixing member. A fixing hole of fixing member 48 including a screw provided in valve stop 42*b* is opened only to the insertion side of fixing member 48 without penetrating valve stop 42*b*. As a result, fixing member 48 is configured to be opened to only intermediate pressure chamber 41. Accordingly, leakage of the working fluid between intermediate pressure chamber 41 and compression chamber 15 through a gap of fixing member 48 can be suppressed, so that the injection rate can be improved.

Intermediate pressure chamber 41 includes a suction volume that is equal to or more than a suction volume of compression chamber 15 to be able to perform sufficient supplying to compression chamber 15 by an injection amount. Herein, the suction volume is the volume of compression chamber 15 at a time point when the working fluid guided from suction port 17 is introduced into and closed in compression chamber 15, that is, at a time point when a suction process is completed, and is the total volume of first compression chamber 15*a* (see FIG. 6) and second compression chamber 15*b* (see FIG. 6). In compressor 91 according to the present embodiment, intermediate pressure chamber 41 is provided to be spread on a flat surface of the end plate of fixed scroll 12 so as to expand the volume thereof. However, when a part of oil 6 enclosed in compressor 91 goes out from compressor 91 together with a discharge refrigerant, and returns to intermediate pressure chamber 41 through injection pipe 95 from gas-liquid separator 96, if the amount of oil 6 remaining in liquid reservoir 41*b* is too large, oil 6 in oil reservoir 20 runs short. Thus, it is not appropriate that the volume of intermediate pressure chamber 41 is too large. Because of this, it is preferable that the volume of intermediate pressure chamber 41 is equal to or more than the suction volume of compression chamber 15, and is equal to or less than a half of the oil volume of enclosed oil 6.

FIG. 6 is a view taken along line 6-6 of FIG. 3.

FIG. 6 is a view showing a state in which orbiting scroll 13 is engaged with fixed scroll 12 when viewed from rear surface 13*e* (see FIG. 3) side of orbiting scroll 13. As illustrated in FIG. 6, in a state in which fixed scroll 12 and orbiting scroll 13 are engaged with each other, a spiral wrap of fixed scroll 12 extends to be equivalent to a spiral wrap of orbiting scroll 13.

Compression chamber 15 formed with fixed scroll 12 and orbiting scroll 13 includes first compression chamber 15*a* formed on an outer wrap wall side of orbiting scroll 13 and second compression chamber 15*b* formed on an inner wrap wall side of orbiting scroll 13.

A spiral wrap is configured such that a position where the working fluid of first compression chamber 15*a* is confined and a position where the working fluid of second compression chamber 15*b* is confined are shifted by about 180 degrees.

At a timing when the working fluid is confined, first compression chamber 15*a* and second compression chamber 15*b* are shifted by about 180 degrees. After first compression chamber 15*a* is closed, shaft 4 is rotated by 180 degrees, so that second compression chamber 15*b* is closed. Accordingly, in first compression chamber 15*a*, influence on suction heating can be reduced, and the suction volume can be maximized. That is, since the wrap height can be set low, and as a result, leakage clearance (=a leakage cross-sectional area) of the radial contact point portion of the wrap can be reduced, leakage loss can be further reduced.

Figure 7:
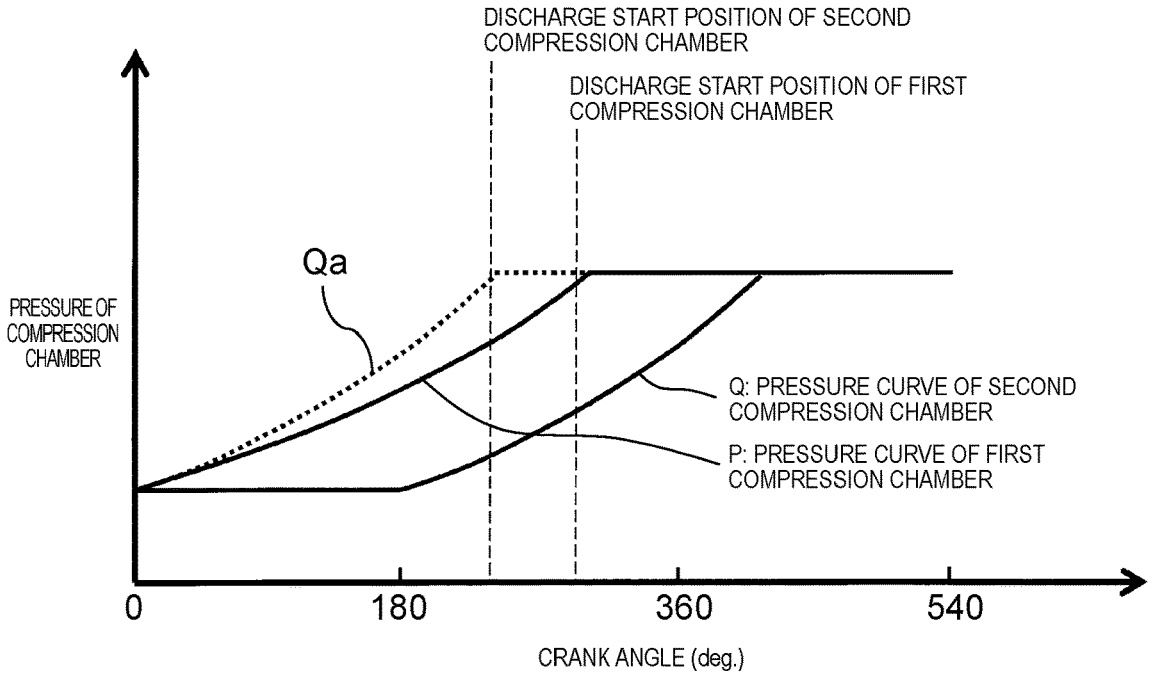
FIG. 7 is a diagram for illustrating a relationship between an internal pressure and a discharge start position of an asymmetric compression chamber of the scroll compressor when an injection operation is not accompanied.

FIG. 7 is a diagram for illustrating a relationship between an internal pressure and a discharge start position of an asymmetric compression chamber of the scroll compressor when an injection operation is not accompanied.

Pressure curve P showing a pressure change of first compression chamber 15*a* with respect to a crank angle that is a rotation angle of a crank, pressure curve Q showing a pressure change of second compression chamber 15*b*, and pressure curve Qa of which a compression start point is matched with a compression start point of pressure curve P by sliding pressure curve Q by 180 degrees are shown in FIG. 7. As can be seen from comparison between pressure curve P and pressure curve Qa of FIG. 7, a pressure increasing rate of second compression chamber 15*b* is faster than a pressure increasing rate of first compression chamber 15*a*.

Therefore, in terms of a rotation angle of shaft 4 from a compression start position, second compression chamber 15*b* early reaches the discharge pressure, as compared to first compression chamber 15*a*. A volume ratio is defined by a ratio of the suction volume of compression chamber 15 to the discharge volume of compression chamber 15 at which the refrigerant can be discharged as compression chamber 15 (see FIG. 3) communicates with discharge port 18 and discharge bypass port 21. A volume ratio of second compression chamber 15*b* having a small suction volume is equal to or less than that of first compression chamber 15*a*. However, in the scroll compressor according to the present embodiment, since first compression chamber 15*a* early reaches the discharge pressure due to an effect of the injection refrigerant, which will be described below, the volume ratio of first compression chamber 15*a* is less than the volume ratio of second compression chamber 15*b*. Accordingly, a problem is solved in which in spite of the fact that compression chamber 15 is compressed such that the internal pressure is equal to or more than the discharge pressure, since compression chamber 15 does not communicate with discharge port 18 or discharge bypass port 21, compression chamber 15 is compressed to the discharge pressure or more.

Further, a slope shape is provided at wrap tip end 13*c* (see FIG. 3) of orbiting scroll 13 from a winding start portion that is a central portion to a winding end portion that is an outer circumferential portion based on a result obtained by measuring a temperature distribution during operation such that a wing height gradually increases. Accordingly, a dimensional change due to heat expansion is absorbed, and local sliding is easily prevented.

Figure 8:
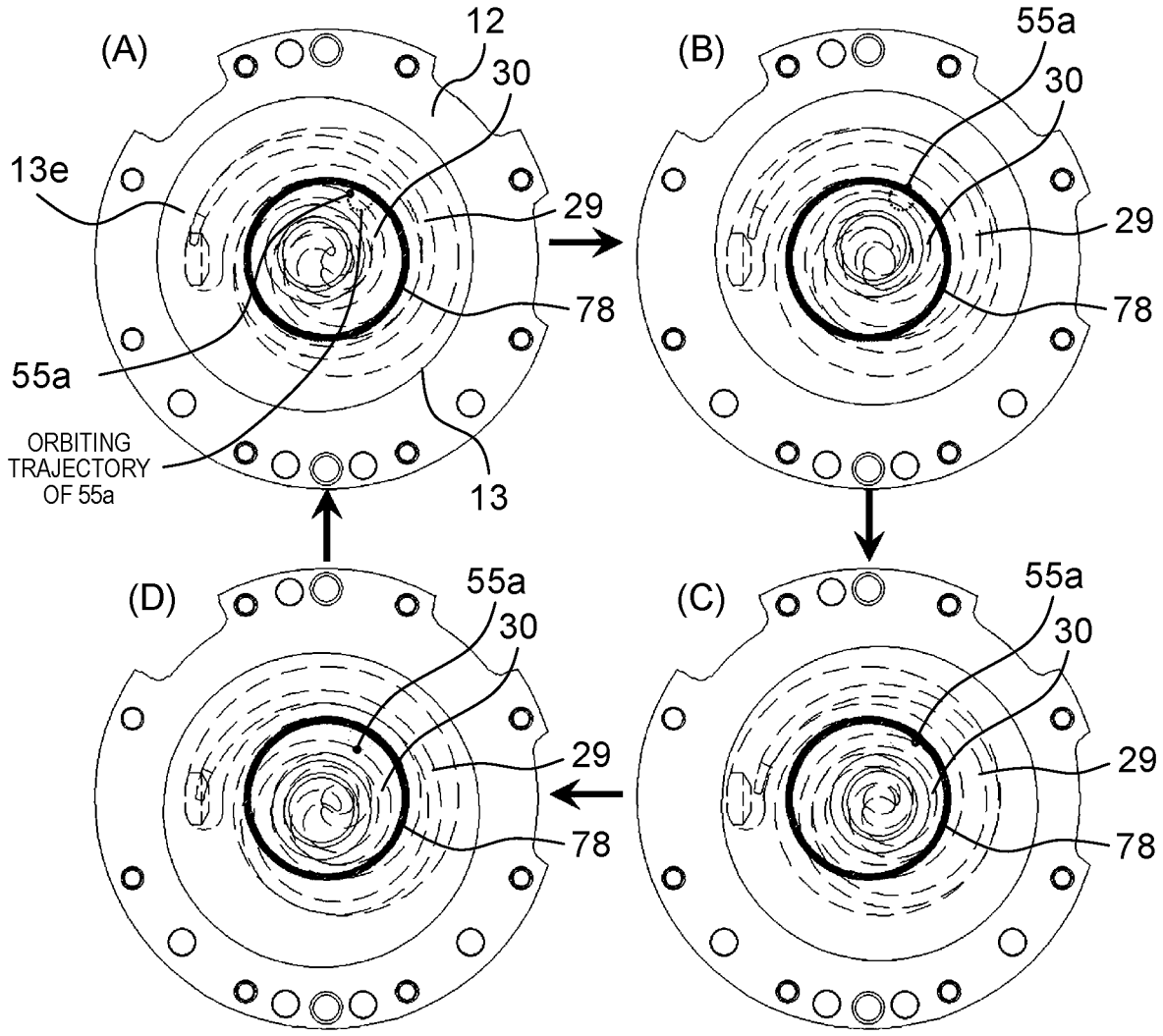
FIG. 8 is a diagram for illustrating a positional relationship between an oil supplying passage and a sealing member accompanying an orbiting movement of the scroll compressor having an injection function according to the first embodiment of the present invention.

FIG. 8 is a diagram for illustrating a positional relationship between an oil supplying passage and a sealing member accompanying an orbiting movement of the scroll compressor that is a compressor according to the present embodiment.

FIG. 8 is a view illustrating a state in which orbiting scroll 13 is engaged with fixed scroll 12 when viewed from rear surface 13*e* side of orbiting scroll 13, in which the phases of orbiting scroll 13 are sequentially shifted by 90 degrees.

First opening end 55*a* of connection passage 55 on one side is formed on rear surface 13*e* of orbiting scroll 13.

As illustrated in FIG. 8, rear surface 13*e* of orbiting scroll 13 is partitioned into high-pressure area 30 on an inner side and back-pressure chamber 29 on an outer side by sealing member 78.

In a state of FIG. 8(B), since first opening end 55*a* is open to back-pressure chamber 29 that is an outer side of sealing member 78, oil 6 is supplied.

In contrast, in FIGS. 8(A), 8(C), and 8(D), since first opening end 55*a* is open to an inside of sealing member 78, oil 6 is not supplied.

That is, although first opening end 55*a* of connection passage 55 travels between high-pressure area 30 and back-pressure chamber 29, oil 6 is supplied to back-pressure chamber 29 only when a pressure difference occurs between first opening end 55*a* and second opening end 55*b* (see FIG. 3) of connection passage 55. With this configuration, since the amount of the supplied oil can be adjusted at a rate of time when first opening end 55*a* travels sealing member 78, the passage diameter of connection passage 55 can be configured to be 10 times or more the size of the oil filter. Accordingly, since there is no risk that foreign substances are caught by passage 13*a* (see FIG. 3) and passage 13*a* is blocked, the scroll compressor can be provided in which the back pressure can be stably applied and lubrication of the thrust sliding portion, rotation restraining mechanism 14 (see FIG. 3) can be maintained in a good state, and high efficiency and high reliability can be realized. In the present embodiment, a case where second opening end 55*b* is always located in high-pressure area 30 and first opening end 55*a* travels between high-pressure area 30 and back-pressure chamber 29 has been described as an example. However, even when second opening end 55*b* travels between high-pressure area 30 and back-pressure chamber 29, and first opening end 55*a* is always located in back-pressure chamber 29, a pressure difference occurs between first opening end 55*a* and second opening end 55*b*. Thus, intermittent oil supplying can be realized and similar effects can be obtained.

Figure 9:
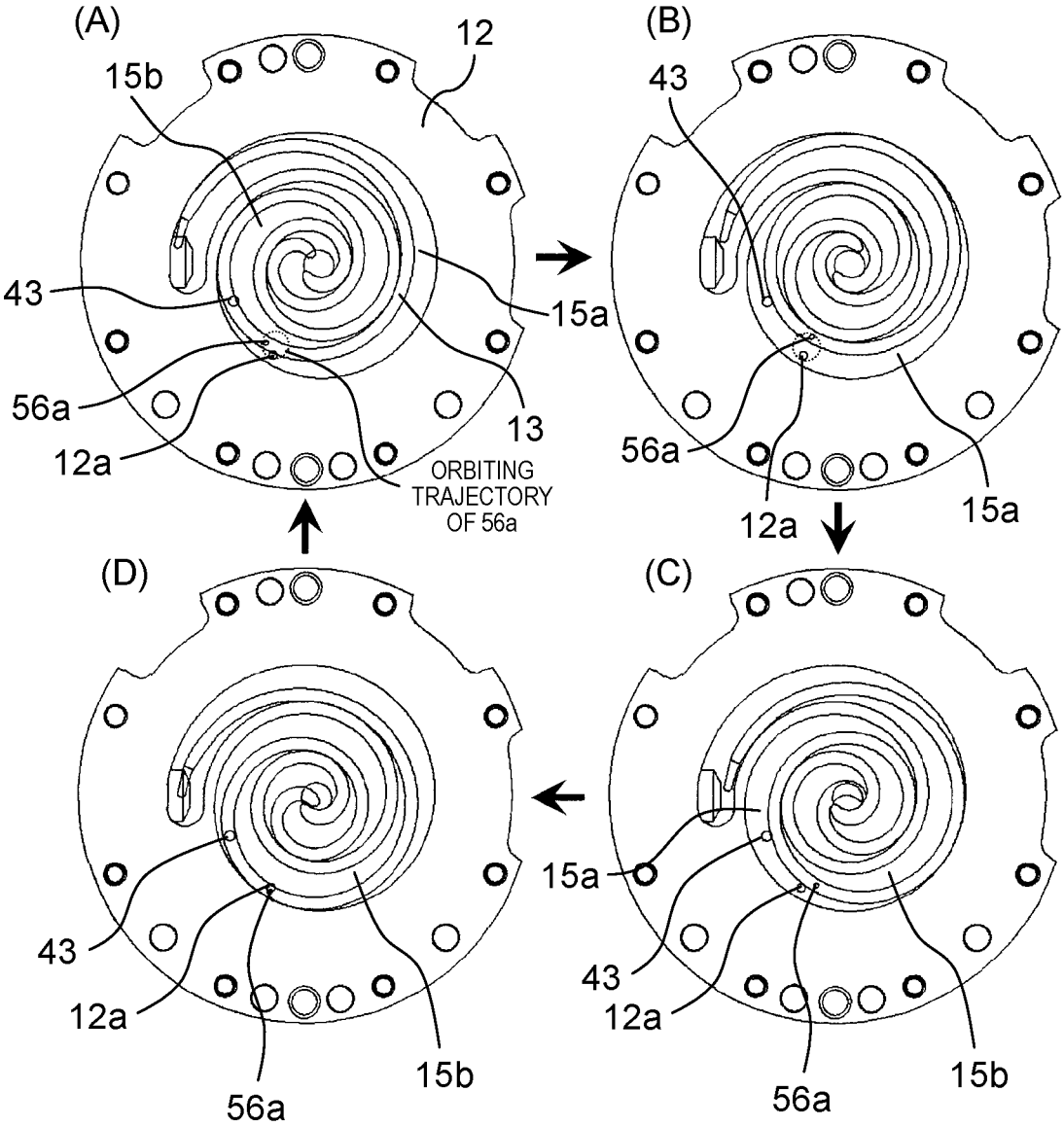
FIG. 9 is a diagram for illustrating an opening state of the oil supplying passage and an injection port accompanying the orbiting movement of the scroll compressor having an injection function according to the first embodiment of the present invention.

FIG. 9 is a diagram for illustrating an opening state of the oil supplying passage and an injection port accompanying the orbiting movement of the scroll compressor that is a compressor according to the present embodiment.

FIG. 9 shows a state in which orbiting scroll 13 is engaged with fixed scroll 12, in which the phases of fixed scroll 12 are sequentially shifted by 90 degrees.

As illustrated in FIG. 9, intermittent communication is realized by periodically opening third opening end 56*a* of passage 13*a* formed in wrap tip end 13*c* (see FIG. 3) to recess 12*a* formed in the end plate of fixed scroll 12.

In a state of FIG. 9(D), the third opening end 56*a* is open to the recess 12*a*. In this state, the oil 6 is supplied from the back-pressure chamber 29 (see FIG. 3) to the second compression chamber 15*b* through the supply passage 56 (see FIG. 3) or the passage 13*a*.

In contrast, in FIGS. 9(A), 9(B), and 9(C), since third opening end 56*a* is not open to recess 12*a*, oil 6 is not supplied from back-pressure chamber 29 to second compression chamber 15*b*. Hereinabove, since oil 6 in back-pressure chamber 29 is intermittently guided to second compression chamber 15*b* through the oil supplying passage, a fluctuation in the pressure of back-pressure chamber 29 can be suppressed, and control can be performed to a predetermined pressure. Further, similarly, oil 6 supplied to second compression chamber 15*b* serves to improve the sealing property and the lubricity during the compression.

In FIG. 9(A) showing a time point when first compression chamber 15*a* is closed, injection port 43 is open to first compression chamber 15*b*. In FIGS. 9(B) and 9(C) showing a state after the compression starts, injection port 43 is open to first compression chamber 15*a*.

Similarly, in FIG. 9(C) showing a time point when second compression chamber 15*b* is closed, injection port 43 is not open to second compression chamber 15*b*. In a state of FIG. 9(A) showing a state in which the compression is progressed, injection port 43 is open to second compression chamber 15*b*. Accordingly, since the injection refrigerant can be compressed without flowing back to suction port 17 (see FIG. 3) while a space of injection port 43 is saved, it is easy to increase the amount of a circulating refrigerant and it is possible to perform a highly efficient injection operation.

At least a part of the oil supplying section to compression chamber 15 is configured to overlap with an opening section of injection port 43. Thus, application of the pressure from rear surface 13*e* to orbiting scroll 13 increases together with the internal pressure of compression chamber 15 during the oil supplying section as the intermediate pressure of the injection refrigerant increases. Therefore, orbiting scroll 13 is more stably pressed against fixed scroll 12, so that stable operation can be performed while leakage from back-pressure chamber 29 to compression chamber 15 is reduced. Accordingly, the behavior of orbiting scroll 13 can more stably realize optimum performance, and can further improve an injection rate.

When R32 or carbon dioxide, in which the temperature of a discharged refrigerant is easy to be high, is used as a refrigerant that is a working fluid, an effect of suppressing an increase in the temperature of the discharged refrigerant is exhibited. Thus, deterioration of a resin material such as an insulating material of motor unit 3 can be suppressed, and a compressor that is reliable for a long time can be provided.

Meanwhile, when a refrigerant having a double bond between carbons or a refrigerant including the refrigerant and having a global warming potential (GWP; a global warming factor) of 500 or less is used, a refrigerant decomposition reaction is likely to occur at high temperatures. Thus, an effect for long-term stability of the refrigerant is exhibited according to the effect of suppressing the increase in the temperature of the discharge refrigerant.

In the compressor having an injection function according to a first disclosure, the compression chamber includes the compression chamber partitioning member configured with, for example, the fixed scroll, the intermediate pressure chamber configured to guide the intermediate pressure working fluid before injection to the compression chamber is provided, and the intermediate pressure chamber and the compression chamber face each other with the compression chamber partitioning member interposed between the intermediate pressure chamber and the compression chamber. Further, the intermediate pressure chamber includes an intermediate pressure chamber inlet in which the intermediate pressure working fluid flows, an injection port inlet of an injection port, through which the intermediate pressure working fluid is injected into the compression chamber, and a liquid reservoir formed at a position lower than the intermediate pressure chamber inlet, and the liquid reservoir includes the compression chamber partitioning member.

With this configuration, even when the liquid-phase working fluid exists in a part of the intermediate pressure working fluid, the working fluid is evaporated in the liquid reservoir by heat of the compression chamber partitioning member to be converted into the gas-phase working fluid. Therefore, since the liquid-phase working fluid is not injected into the compression chamber, the operation can be performed at high efficiency at an optimum intermediate pressure, and lubricity of the sliding parts does not deteriorate by the liquid refrigerant, a highly reliable compressor can be realized.

According to a second disclosure, in the compressor according to the first disclosure, the sealed container enclosing a predetermined amount of oil may have the compression chamber therein, and the volume of the intermediate pressure chamber may be equal to or larger than the suction volume of the compression chamber and may be equal to or smaller than a half of the oil volume of the enclosed oil.

According to the present embodiment, a highly reliable compressor is provided in which while the intermediate pressure chamber secures a volume sufficient for injecting the intermediate pressure working fluid, since the oil necessary for lubrication may be left in the liquid reservoir even when a part of the oil is collected in the liquid reservoir of the intermediate pressure chamber, the liquid reservoir does not interfere with supply of the oil to the sliding portions.

According to a third disclosure, in the compressor according to the first or second disclosure, the injection port inlet may be provided at a position above the intermediate pressure chamber inlet.

With this configuration, since the liquid component of the working fluid introduced from the intermediate pressure chamber inlet cannot reach the injection port, and is guided to the liquid reservoir, the gas-phase component of the working fluid can be injected into the compression chamber.

According to a fourth embodiment in the compressor according to the first or second disclosure, the compression chamber partitioning member may be provided with a discharge hole through which the high-pressure working fluid discharged from the compression chamber to the discharge chamber, and the discharge chamber and the intermediate pressure chamber may be adjacent to each other.

With this configuration, the working fluid in the liquid reservoir in the intermediate pressure chamber is easily evaporated by heat of the discharged high-temperature working fluid.

According to a fifth disclosure, in the compressor according to the first or second disclosure, R32 or carbon dioxide may be used as the working fluid.

R32 and carbon dioxide are high-temperature refrigerants, the discharge temperature thereof easily rises, and operational high-pressure limit is determined based on safety such as facility protection. With this configuration, since the temperature of the discharge refrigerant having a high temperature is lowered by the injected refrigerant, the operational region can be expanded.

According to a sixth disclosure, in the compressor according to the first or second disclosure, a refrigerant having a double bond between carbons or a refrigerant including the refrigerant and having a global warming potential (GWP; a global warning factor) of 500 or less may be used as the working fluid.

Since the refrigerant having a double bond between carbons is unstable and is easily decomposed at a high temperature, it is necessary to suppress an increase in the temperature. With this configuration, a reliable compressor can be provided in which since the temperature of the discharge refrigerant is greatly reduced due to mixing with the injected refrigerant and heat exchange with the refrigerant in the liquid reservoir, decomposition of the refrigerant is suppressed.

According to a seventh disclosure, in the compressor according to the first or second disclosure, a check valve preventing backflow of the intermediate-pressure working fluid from the compression chamber to the intermediate pressure chamber may be installed in the injection port.

In a stage in which the pressure is increased from the suction pressure to the discharge pressure inside the compression chamber, the working fluid flows from the injection port using a pressure difference between the internal pressure and the intermediate pressure of the compression chamber. However, since the intermediate pressure is determined from the viewpoint of the injection amount, a timing at which the injection port communicates with an inside of the compression chamber is not always optimal, and even in the communication state, the internal pressure of the compression chamber may be higher than the intermediate pressure. With this configuration, as the check valve is provided in the injection port, backflow of the working fluid from the compression chamber to the intermediate pressure chamber can be prevented, and a high-efficiency high-performance operation can be realized in various operational situation.

According to an eighth disclosure, in the compressor according to the seventh disclosure, the intermediate pressure chamber may include the compression chamber partitioning member configured with, for example, the fixed scroll and the intermediate pressure chamber partitioning member configured with, for example, the intermediate pressure plate and the intermediate pressure cover. The check valve may be installed at a boundary surface between the intermediate pressure chamber partitioning member and the compression chamber partitioning member.

With this configuration, as the check valve is provided in the vicinity of the compression chamber, a dead volume can be reduced during a compression stroke, and a high-efficiency operation having a high injection rate can be performed.

According to a ninth disclosure, in the compressor according to the eighth disclosure, fixing members for fixing the check valve may be provided in the intermediate pressure chamber partitioning member and the compression chamber partitioning member.

With this configuration, since the working fluid can be prevented from leaking between the intermediate pressure chamber and the compression chamber through a gap of the fixing members, high-efficiency operation having a high injection rate can be performed.

According to a tenth disclosure, in the compressor according to the seventh disclosure, a reed valve may be installed such that the injection port is opened and closed using a reed valve as the check valve.

In the reed valve, the number of sliding portions in a movable portion is small, sealing performance can be maintained for a long time, and a flow passage area is easily expanded as needed. Thus, with this configuration, high-efficiency operation having a high injection rate and high reliability can be provided.

According to an eleventh disclosure, in the compressor according to the tenth disclosure, a valve stop restraining the maximum displacement amount of the reed valve may be provided, and the thickness of the valve stop may vary depending on a lift regulation point of the reed valve.

A side where the reed valve in the injection port is lifted, opened, and closed is a part of the compression chamber in communication with the compression chamber, and a space more than necessary becomes the dead volume, which causes a reduction in efficiency of the compressor. When the thickness of the valve stop is constant, a space is generated on a rear surface of the valve stop in the vicinity of a root of the reed valve, which causes a reduction in the efficiency. With this configuration, such a space can be removed by a change in the plate thickness of the valve stop, and this is especially effective in a high lift-type reed valve having the large amount of injection.

INDUSTRIAL APPLICABILITY

The present invention is not only limited to the scroll compressor in which the injection at the intermediate pressure is performed, but also is useful in all types of compressors, such as a rotary type compressor, which perform the injection. Also, as usage, the present invention is useful in a refrigeration cycle device which can be used in an electrical product such as a hot water heater, a water heater, and a refrigerator as well as an air conditioner.

REFERENCE MARKS IN THE DRAWINGS

1 SEALED CONTAINER
2 COMPRESSION MECHANISM
3 MOTOR UNIT
4 SHAFT
**4*a*** ECCENTRIC SHAFT PORTION
6 OIL
11 MAIN BEARING MEMBER
12 FIXED SCROLL (COMPRESSION CHAMBER PARTITIONING MEMBER)
**12*a*** RECESS
13 ORBITING SCROLL
**13*c*** WRAP TIP END
**13*e*** REAR SURFACE
14 ROTATION RESTRAINING MECHANISM
15 COMPRESSION CHAMBER
**15*a*** FIRST COMPRESSION CHAMBER
**15*b*** SECOND COMPRESSION CHAMBER
16 SUCTION PIPE
17 SUCTION PORT
18 DISCHARGE PORT
19 DISCHARGE REED VALVE
20 OIL RESERVOIR
21 DISCHARGE BYPASS PORT
25 PUMP
26 OIL SUPPLYING HOLE
29 BACK-PRESSURE CHAMBER

30 HIGH-PRESSURE AREA
31 DISCHARGE CHAMBER
41 INTERMEDIATE PRESSURE CHAMBER
41*a* INTERMEDIATE PRESSURE CHAMBER INLET
41*b* LIQUID RESERVOIR
42 CHECK VALVE
42*a* REED VALVE
42*b* VALVE STOP
43 INJECTION PORT
43*a* INJECTION PORT INLET
44 INTERMEDIATE-PRESSURE PLATE (INTERMEDIATE PRESSURE CHAMBER PARTITIONING MEMBER)
45 INTERMEDIATE-PRESSURE COVER (INTERMEDIATE PRESSURE CHAMBER PARTITIONING MEMBER)
48 FIXING MEMBER (BOLT)
55 CONNECTION PASSAGE
55*a* FIRST OPENING END
55*b* SECOND OPENING END
56 SUPPLY PASSAGE
56*a* THIRD OPENING END
56*b* FOURTH OPENING END
66 BEARING PORTION
78 SEALING MEMBER
91 COMPRESSOR
92 CONDENSER
93 EVAPORATOR
94*a*, 94*b* EXPANSION VALVES
95 INJECTION PIPE
96 GAS-LIQUID SEPARATOR

The invention claimed is:

1. A compressor having an injection function, the injection function including: suctioning a low-pressure working fluid; injecting an intermediate pressure working fluid into a compression chamber in a process of compressing the low-pressure working fluid; and discharging a high-pressure working fluid, the compressor comprising:

the compression chamber including a compression chamber partitioning member;

an intermediate pressure chamber guiding the intermediate pressure working fluid before the injection to the compression chamber, wherein the intermediate pressure chamber and the compression chamber face each other with the compression chamber partitioning member interposed between the intermediate pressure chamber and the compression chamber, the intermediate pressure chamber includes:

an intermediate pressure chamber inlet through which the intermediate pressure working fluid flows in;

an injection port inlet of an injection port through which the intermediate pressure working fluid is injected into the compression chamber; and a liquid reservoir formed at a position below the intermediate pressure chamber inlet, the liquid reservoir including the compression chamber partitioning member, the compressor further comprising:

a check valve preventing backflow of the intermediate pressure working fluid from the compression chamber to the intermediate pressure chamber provided in the injection port;

the intermediate pressure chamber including the compression chamber partitioning member and an intermediate pressure chamber partitioning member; and the check valve installed on a boundary surface between the intermediate pressure chamber partitioning member and the compression chamber partitioning member.

2. The compressor of claim 1, the compressor comprising:

a sealed container enclosing a predetermined amount of oil, having the compression chamber therein; and the intermediate pressure chamber having a volume equal to or larger than a suction volume of the compression chamber and equal to or smaller than a half of an oil volume of the enclosed oil.

3. The compressor of claim 1, the compressor comprising:

the injection port inlet provided at a position above the intermediate pressure chamber inlet.

4. The compressor of claim 1, the compressor comprising:

the compression chamber partitioning member provided with a discharge hole through which the high-pressure working fluid discharged from the compression chamber to a discharge chamber:

and the discharge chamber and the intermediate pressure chamber adjacent to each other.

5. The compressor of claim 1, the compressor comprising:

R32 or carbon dioxide used as the low-pressure working fluid, the intermediate pressure working fluid, and the high-pressure working fluid.

6. The compressor of claim 1, the compressor comprising:

a refrigerant having a double bond between carbons or a refrigerant admixture and having a global warming potential (GWP; a global warning factor) of 500 or less and including a refrigerant having a double bond between carbons used as the low-pressure working fluid, the intermediate-pressure working fluid, and the high-pressure working fluid.

7. The compressor of claim 1, the compressor comprising:

a fixing member fixing the check valve provided in the intermediate pressure chamber partitioning member or the compression chamber partitioning member.

8. The compressor of claim 1, the compressor comprising:

a reed valve installed such that the injection port opened and closed using the reed valve as the check valve.

9. The compressor of claim 8, the compressor comprising:

a valve stop restraining displacement of the reed valve; and a thickness of the valve stop varying depending on a lift regulation position of the reed valve.

* * * * *